US005588066A

United States Patent [19]

Yang et al.

[11] Patent Number: 5,588,066

[45] Date of Patent: Dec. 24, 1996

[54] SPEAKER MOUNTING STRUCTURE

[76] Inventors: Su-Pei Yang, 2F, No. 110, Lane 103, Sec. 2, Nei Hu Rd.; Shyh-Lee Chen, No. 16, Alley 12, Lane 190, Chorng Yang Rd., Nan Gang District, both of Taipei, Taiwan

[21] Appl. No.: 646,012

[22] Filed: May 7, 1996

[51] Int. Cl.[6] ..... H04R 25/00

[52] U.S. Cl. ..... 381/188; 381/87

[58] Field of Search ..... 381/188, 205, 381/87, 88, 90; 361/400, 405; 181/150, 199

[56] References Cited

U.S. PATENT DOCUMENTS 5,239,589 8/1993 Yang et al. ..... 381/188

*Primary Examiner*—Sinh Tran

*Attorney, Agent, or Firm*—Bacon & Thomas

[57] ABSTRACT

A speaker mounting structure including a speaker casing, a positioning block and two contact legs. The positioning block is a curved, stepped structure with two positioning posts at a bottom side thereof, a resilient retaining clamp being disposed therebetween. The speaker casing is provided with mounting holes for receiving the positioning posts and the resilient retaining clamp. The positioning block is further provided with two recesses and two through holes at an upper side thereof for mounting and positioning the contact legs. Two oblique guide grooves are disposed between the recesses for guiding the negative and positive wires.

2 Claims, 4 Drawing Sheets

SPEAKER MOUNTING STRUCTURE

BACKGROUND OF THE INVENTION (a) Field of the Invention

The present invention relates generally to a speaker mounting structure, and more particularly to a speaker mounting structure having a positioning block for pressing tightly against a speaker casing to eliminate the need for welding, enhance assembly efficiency and allows easy dismantling.

(b) Description of the Prior Art

A contact leg positioning device for speakers of the prior art is shown in FIG. 8. It essentially comprises a speaker 10 having a hole 20 at its periphery for mounting an insulating positioning piece 30 by means of a rivet 40. Two contact legs 60 are welded to the positive and negative poles of the positioning piece 30 respectively via two electrically conductive pieces 50, accomplishing electrical wire connection of the speaker 10. The speaker 10 further has a plurality of positioning legs 70 for insertable arrangement on a circuit board (not shown). The contact legs 60 are disposed in insert holes provided on the circuit board and are assembled thereto by means of hot melt welding.

SUMMARY OF THE INVENTION

According to a first aspect of the present invention, a preferred embodiment of the speaker mounting structure comprises a positioning block fitted tightly onto a peripheral portion of a speaker casing, a couple of contact legs inserted into corresponding through holes in the positioning block, thereby facilitating assembly and ensuring the contact legs to be precisely positioned on a circuit board.

According to another aspect of the present invention, a preferred embodiment of the speaker mounting structure comprises a positioning block having a resilient retaining clamp at a bottom side thereof for fitting into a slot located at a peripheral portion of a speaker casing, the retaining clamp consisting of two hook portions arranged back-to-back such that the hook portions may be squeezed into the slot and then extended to clamp the side walls of the slot, thereby allowing the retaining clamp to be easily disengaged from the slot of the speaker casing.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
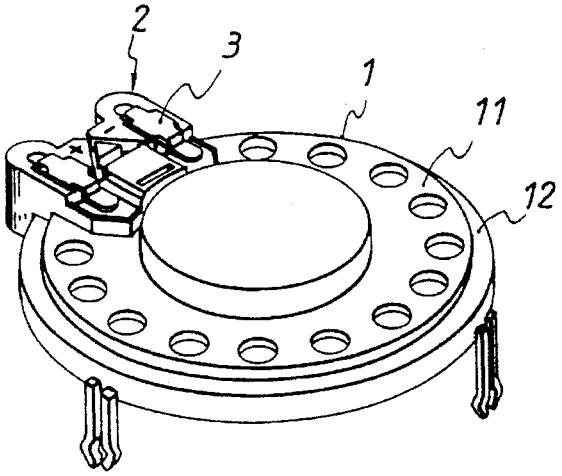
FIG. 1 is an elevational view of a preferred embodiment of the speaker mounting structure of the present invention.
Figure 2:
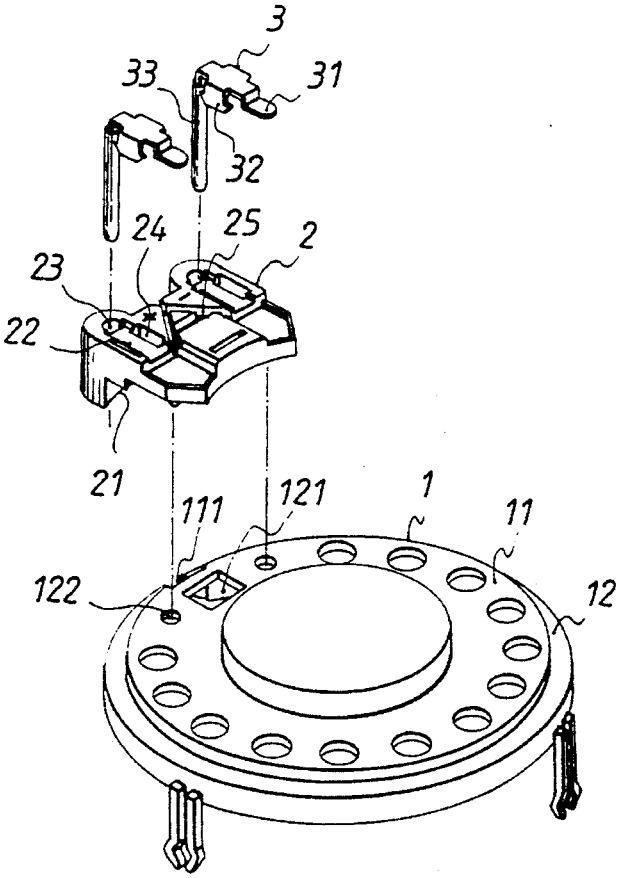
FIG. 2 is an exploded, elevational view of the preferred embodiment of the speaker structure of the present invention.

With reference to FIGS. 1 and 2, the positioning device according to the present invention essentially comprises a speaker casing 1, a positioning block 2 and two contact legs 3. The speaker casing 1 is an annular structure integrally formed by punching. Its circumferential wall is stepped to form an upper wall 11 of a smaller diameter and a lower wall 12 of a larger diameter. A notch 111 is formed in the upper wall 11 at a determined position by punching, while a slot 121 is provided on the lower wall 12 at a corresponding position. Two positioning holes 122 are disposed at both sides of the slot 12 respectively.

Figure 3:
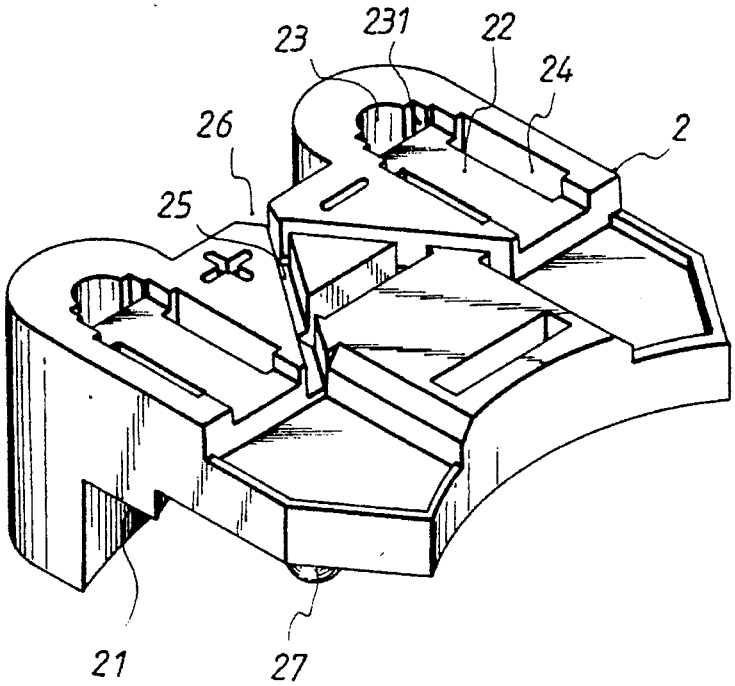
FIG. 3 is an elevation view of a positioning block according to the present invention.
Figure 4:
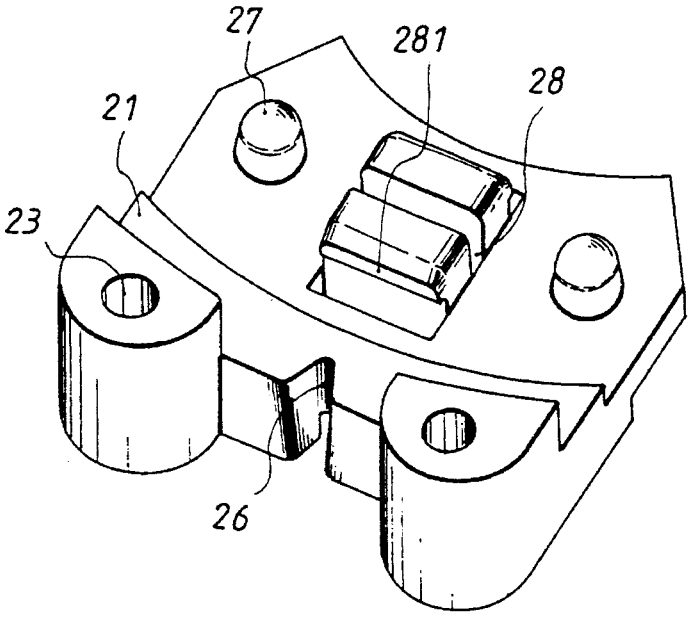
FIG. 4 is an elevational view of a bottom side of the positioning block according to the present invention.

The positioning block 2 is a curved, stepped structure, as shown in FIGS. 3 and 4. It consists of a stepped portion 21 for matching the upper and lower walls 11, 12 of the speaker casing 1 so that it may fit tightly thereonto, two mounting recesses 22 located at an upper surface thereof, an axially oriented through hole 23 provided at a rear end of each mounting recess 22, the through hole 23 having an inner wall provided with an enlarged, stepped portion 231 at a suitable position, an elongate slot 24 disposed at the lateral sides of the mounting recess 22, two oblique guide grooves 25 disposed between the two mounting recesses 22 such that they extend from the inner front ends of the mounting recesses 22 to converge at an indented wall 26 at the middle of a rear edge of the positioning block 2, two positioning posts 27 disposed at both sides of a bottom surface of the positioning block 2, and a resilient retaining clamp 28 disposed between the positioning posts 27, the retaining clamp 28 having two back-to-back hook portions 281 at its ends.

The contact leg 3 is a substantially inverted-L shaped, electrically conductive piece, consisting of a horizontal portion and a vertical portion. The horizontal portion of the contact leg 3 has a stepped, connecting element 31 at a front end thereof, and two extended, hook elements 32 extending downwardly from both lateral sides thereof such that they may just fit tightly into the elongate slots 24 of the corresponding mounting recess 22 of the positioning block 2. The vertical portion of the contact leg 3 constitutes a leg portion 33 which may be inserted into the through hole 23 at the rear end of the mounting recess 22.

Figure 5:
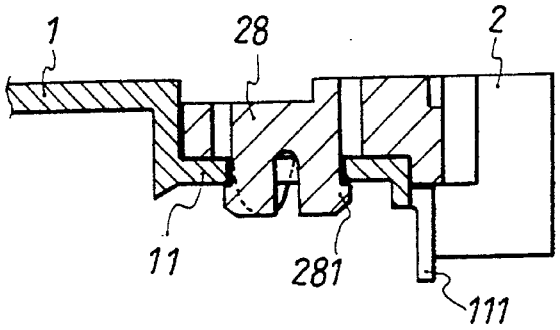
FIG. 5 is a partially schematic, sectional view showing the positioning block fitted onto a speaker casing.
Figure 6:
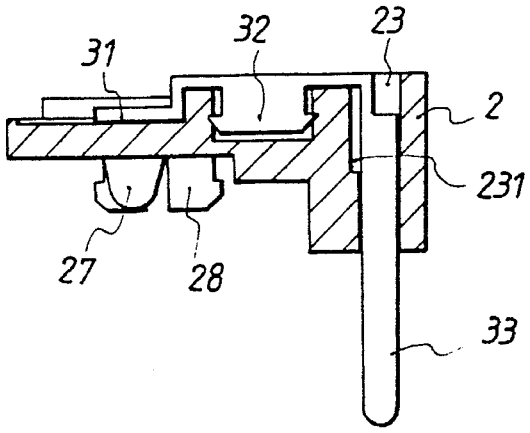
FIG. 6 is a schematic, sectional view showing a contact leg fitted into the positioning block.

In assembly, the positioning posts 27 and the resilient retaining clamp 28 are respectively fit into the positioning holes 122 and the slot 121 at the lower wall 12 of the speaker casing 1. As the hook portions 281 of the resilient retaining clamp 28 are arranged back-to-back and have suitable resilience, the resilient retaining clamp 28 may be squeezed into the slot 121 and be firmly retained therein when the hook portions 281 extend (as shown in FIG. 5). The elongate slots 24 at both sides of the respective mounting recesses 22 receive the extended, hook portions 32 of the contact leg 3. The leg portion 33 of the contact leg 3 is inserted through the through hole 23 at the rear end of the mounting recess 22 (as shown in FIG. 6). By means of this arrangement, the contact legs 3 may be speedily mounted onto the positioning block 2 disposed on the speaker casing 1. Furthermore, the guide grooves 23 between the mounting recesses 22 are provided to guide the negative and positive wires extending upwardly from the notch 111 of the speaker casing 1 to the indented wall 26 of the positioning block 2 to be connected to the connecting elements 31 of the contact legs 3. Such an arrangement eliminates the problem of wire entanglement in the prior art, which is not provided with any wire guide or positioning means.

Figure 7:
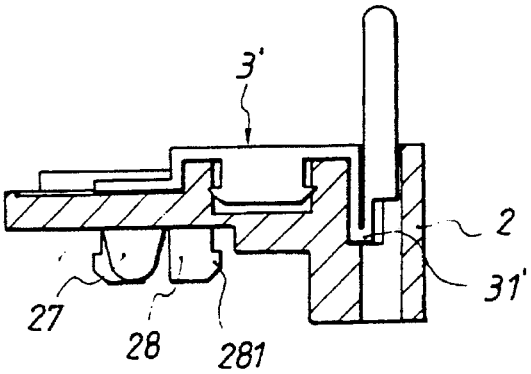
FIG. 7 a schematic, sectional view showing a contact leg fitted into a positioning block according to another preferred embodiment of the present invention.
Figure 8:
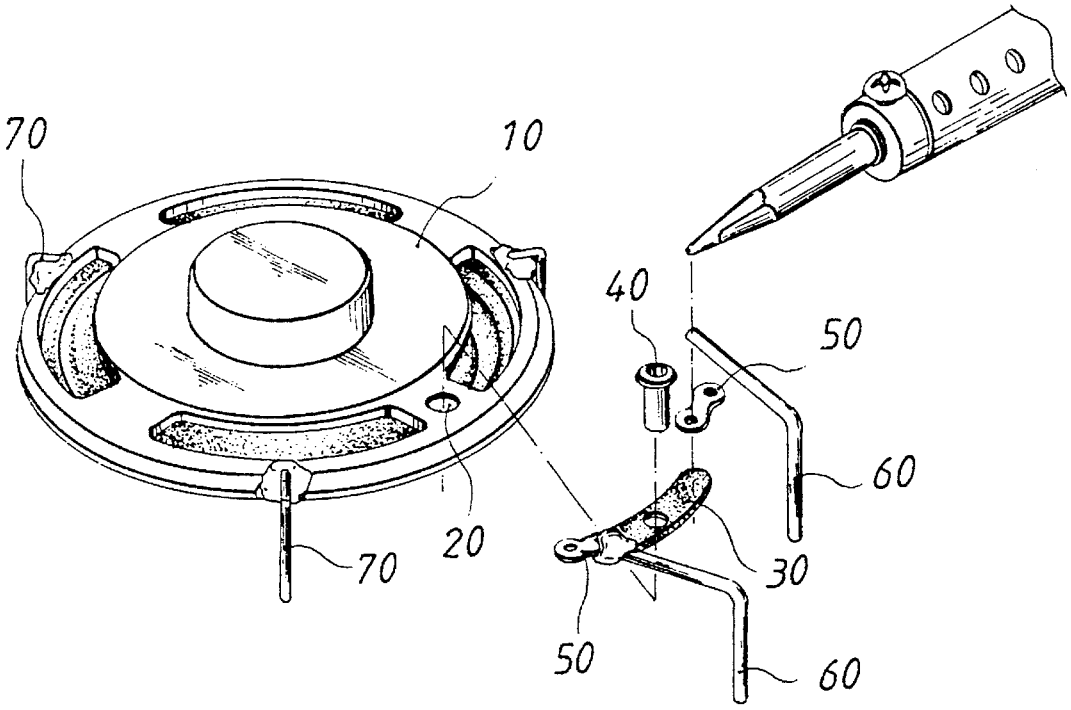
PRIOR ART FIG. 8
FIG. 8 is an exploded, schematic view illustrating the prior art.

According to the spirit of the present invention, the mounting recess 22 at the upper surface of the positioning block 2 may be configured to receive and position an upwardly extending contact leg' which has a hook portion 31' engaging the enlarged, stepped portion 231 of the through hole 23, as shown in FIG. 7.

Although the present invention has been illustrated and described with reference to the preferred embodiment thereof, it should be understood that it is in no way limited to the details of such embodiment but is capable of numerous modifications within the scope of the appended claims.

What is claimed is:

1. A speaker mounting structure, comprising:

a speaker casing which is an annular structure integrally formed by punching, said speaker having a stepped circumferential wall consisting of an upper wall of a smaller diameter and a lower wall of a larger diameter, a notch being formed in said upper wall at a determined position by punching, a slot being provided at said lower wall at a position corresponding to that of said notch, and two positioning holes being disposed at both sides of said slot respectively;

a positioning block which is a curved, stepped structure consisting of a stepped portion for matching said upper and lower walls of said speaker casing so that it may fit tightly thereonto, two mounting recesses located at an upper surface thereof, an axially oriented through hole provided at a rear end of each of said mounting recesses, an elongate slot disposed at either lateral side of each of said mounting recesses, two oblique guide grooves disposed between said two mounting recesses such that they extend from inner front ends of said mounting recesses to converge at an indented wall at the middle of a rear edge of said positioning block, two positioning posts respectively disposed at both sides of a bottom surface of said positioning block, and a resilient retaining clamp disposed between said positioning posts, said resilient clamp having two back-to-back hook portions at its ends;

two contact legs each being a substantially inverted-L shaped, electrically conductive piece and consisting of a horizontal portion and a vertical portion, said horizontal portion thereof having a stepped, connecting element at a front end thereof and two extended, hook elements extending downwardly from both lateral sides thereof such that they may just fit tightly into said elongate slots of the corresponding mounting recess of said positioning block, said vertical portion constituting a contact leg portion which may be inserted into said through hole at the rear end of the corresponding mounting recess;

said positioning posts and said resilient retaining clamp being respectively fitted into said positioning holes and said slot at said lower wall of said speaker casing, said back-to-back hook portions of said resilient retaining clamp having suitable resilience such that said resilient retaining clamp may be squeezed into said slot and be firmly retained therein, said elongate slots at both sides of the respective mounting recesses receiving said extended, hook elements of said contact legs, said contact leg portion of each of said contact legs being inserted through said through hole at the rear end of each of said mounting recesses, said guide grooves between said mounting recesses being provided to guide the negative and positive wires extending upwardly from said notch of said speaker casing to said indented wall of said positioning block to be connected to said connecting elements of said contact legs.

2. A speaker mounting structure as claimed in claim 1, wherein said through hole has an inner wall provided with an enlarged, stepped portion at a suitable position for receiving and positioning said contact leg portion extending upwardly thereinto.

* * * * *